US006568710B2

(12) United States Patent
Kim

(10) Patent No.: US 6,568,710 B2
(45) Date of Patent: May 27, 2003

(54) SKATE BLADE ANGLE CONTROLLING DEVICE OF SKATES FOR SHORT TRACK

(76) Inventor: Mu-jung Kim, 679-34, Jayang 2-dong, Kwangjin-ku, Seoul 143-192 (KR)

( * ) Notice: Subject to any disclaimer, the term of this patent is extended or adjusted under 35 U.S.C. 154(b) by 0 days.

(21) Appl. No.: 09/996,697

(22) Filed: Nov. 30, 2001

(65) Prior Publication Data

US 2002/0041079 A1 Apr. 11, 2002

Related U.S. Application Data

(63) Continuation of application No. 09/640,781, filed on Aug. 18, 2000, now abandoned.

(30) Foreign Application Priority Data

Aug. 20, 1999 (KR) ..... 99-17329
Mar. 30, 2000 (KR) ..... 2000-9030

(51) Int. Cl.[7] ..... A63C 11/00; A63C 3/00
(52) U.S. Cl. ..... 280/809; 280/11.18
(58) Field of Search ..... 280/609, 11.12, 280/11.14, 11.15, 11.16, 11.18, 842, 11.27, 11.224, 11.26, 22.1, 26, 28, 607, 633, 841, 809

(56) References Cited

U.S. PATENT DOCUMENTS 1,499,448 A * 7/1924 Crawford ..... 280/11.28
2,931,012 A * 3/1960 Kosach ..... 280/11.24
3,947,050 A * 3/1976 Isely ..... 280/11.18
4,139,209 A * 2/1979 Humphreys ..... 280/11.12
5,137,290 A * 8/1992 Patterson et al. ..... 280/11.12
5,303,940 A * 4/1994 Brandner ..... 280/11.22
5,452,907 A * 9/1995 Meibock et al. ..... 280/11.22
5,566,957 A * 10/1996 Ho ..... 280/11.22
6,003,882 A * 12/1999 Colonese, Jr. et al. ... 280/11.22

* cited by examiner

*Primary Examiner*—Brian L. Johnson
*Assistant Examiner*—Gerald Klebe
(74) *Attorney, Agent, or Firm*—Arent Fox Kintner Plotkin & Kahn, PLLC

(57) ABSTRACT

A skate blade angle controlling device fastened to a lower face of a fixing plate having a rectangular, integral projection part. A fastening bolt is screw-fastened through the fixing plate to a fastening nut onto a connection flat provided on an upper face of the skate blade. A pivotally moving part has an open upper face closed by a lower part of the projection part and has one side pivotally mounted on the projection part on a hinge axle. A concave flute of a concave shape is formed in a lower part of the projection part positioned away from the hinge axle. A controlling plate having a fastening hole is inserted into the concave flute. A controlling screw is fastened in the fastening hole from the top to control the pivoting angle of the pivotally moving part by an upward and downward movement of the controlling plate.

5 Claims, 6 Drawing Sheets

SKATE BLADE ANGLE CONTROLLING DEVICE OF SKATES FOR SHORT TRACK

This is a continuation of Application No. 09/640,781 filed Aug. 18, 2000 and now abandoned. The disclosure of the prior application(s) is hereby incorporated by reference herein in its entirety.

BACKGROUND OF THE INVENTION

1. Field of the Invention

The present invention relates to a skate blade angle controlling device for skates used on a short track, and more particularly, to a skate blade angle controlling device for skates used on a short track, which is capable of enhancing a contacting force between the skate blade and an ice surface and preventing a user from sliding as a result of centrifugal force, to thereby gain maximum safety for cornering by the user, by optionally controlling at any time an angle of a skate blade fastened to a lower surface of a fixing plate so as to match a physical condition of the user so by maintaining a maximum vertical state of the skate blade against the ice surface even under a state where the user leans his body at a maximum angle.

2. Description of the Prior Art

In general, a short track is a scoring game requiring skating at a most rapid speed on a frozen ice track within an indoor narrow track. Due to a characteristic of the narrow track, an inclined angle of a cornering portion on the ice track is relatively severe. Thus in the construction of skates for use on a short track, the skate blade is not positioned at a center of a skate shoe but is formed in an outward eccentric state comparatively to conventional skates, so as to safely skate on a cornering portion of the track having a severe inclined angle, particularly at a rapid skating speed.

In such conventional skates for a short track, a fixing plate made of metal is combined with respective front and back surfaces of a skate bottom, and is provided with a fastening bolt directed to a lower direction on one side of the fixing plate. This fastening bolt extends through a bracket combined with a holder holding a skate blade and, in such a state, the fastening bolt is fastened and fixed by a nut.

In such construction for skates used on a short track, the skate blade is positioned to maintain the eccentric state towards the outward direction of the skate, namely, an outer side of the track under rapid skating, instead of a position at a center of the skate, so that the user may rapidly skate on a corner of the track with maintenance of rapid speed in a safe manner and with maximum maintenance of safety in an inner side thereof while cornering.

However, in such skates for the short track, the skate blade in a lower part of the skate is provided at the outward eccentric state instead of the central position of the skate, to perform safe cornering without sliding dangerously outwardly even in a rapid skating state when skating on a corner of the track. It is thus constructed that the skate blade is slanted according to an inclined angle so that the upper body of the user inclines to the inside direction of the track when cornering, since the skate blade maintains its vertical state against the skate shoe, that is, a contacting force between the skate blade and the ice surface is lessened and a sliding action to the outer direction occurs often by centrifugal force. At this time, the user/player reduces his skating speed for safety while cornering, which makes it difficult obtain a good score in a game. In the event the user rapidly skates without speed reduction while cornering to obtain a good score in the game, he/she may be injured in an accident owing to his/her sliding and falling-down outwardly since the contacting force between the skate blade and the frozen surface drops.

To overcome such shortcoming the Korean Opening Utility Model Publication Opening No. 98-26579 had been provided.

In this construction, a combination part slanted downwardly in a side direction thereof is formed on the lower face of the fixing plate affixed to a lower face of the skate shoe so the skate blade is slanted against the fixing plate, to thereby maintain a vertical state of the skate blade on the frozen surface through an inclined angle of the combination part, to maintain the contacting force of the skate blade with the frozen surface and to prevent a maximum sliding action outwardly for safe cornering even when the player inclines towards the cornering direction while cornering.

In such conventional construction, however, the combination part having a given inclined angle is provided in one body with the fixing plate causing an inconvenience to the user since the inclined angle of the combination part does not comply with the physical condition of the user.

Describing in detail, the physical condition or individual abilities of the players are different respectively. In other words, the players rapidly skate in a different state with respect to skating speed and angle while cornering. At this time, the inclined angle of the combination part is maintained at a constant state, which rather causes cornering under an unstable state.

That is to say, in a case of the player who has a t physical condition appropriate to the inclined angle of the combination part, he/she can stably skate while cornering on the track and obtain a good score. But in case that the physical condition is larger or smaller than the inclined angle, there is an inconvenience in its construction in that the inclined angle of the combination part is formed differently respectively according to the players individual physical conditions and abilities because the inclined angle of the combination part is not matched with these characteristics of the players. In cases where the players' individual abilities are improved and they attempt to skate at more rapid speed while cornering, they should incline their bodies to a lower position in the cornering direction. At this time, when the player's body inclines more than an angle of the inclined angle of the combination part, the skate blade does not stand vertically and quickly moves to some lying state to bring about a sliding action outwardly by centrifugal force. Accordingly, the contacting force between the skate blade and the frozen surface drops. To overcome such shortcomings, new skate shoes have a different inclined angle of the combination part and should be purchased every time the ability of the player improves, which causes the player an economic burden.

SUMMARY OF THE INVENTION

It is, therefore, a primary object of the present invention to provide a skate blade angle controlling device for skates used on a short track, in which an inclined angle of skate blade can be freely controlled according to the physical condition and ability of a player who puts on his/her skates, thereby the player can rapidly skate on a cornering track in a safe manner by controlling the inclined angle in conformity with improvement of the player's ability, with one pair of skates, to enable to obtain a good score in the game. And the player can reduce his economic burden in that the skates based on the inclined angle of the skate blade should be openly exchanged and purchased.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

Figure 3A:
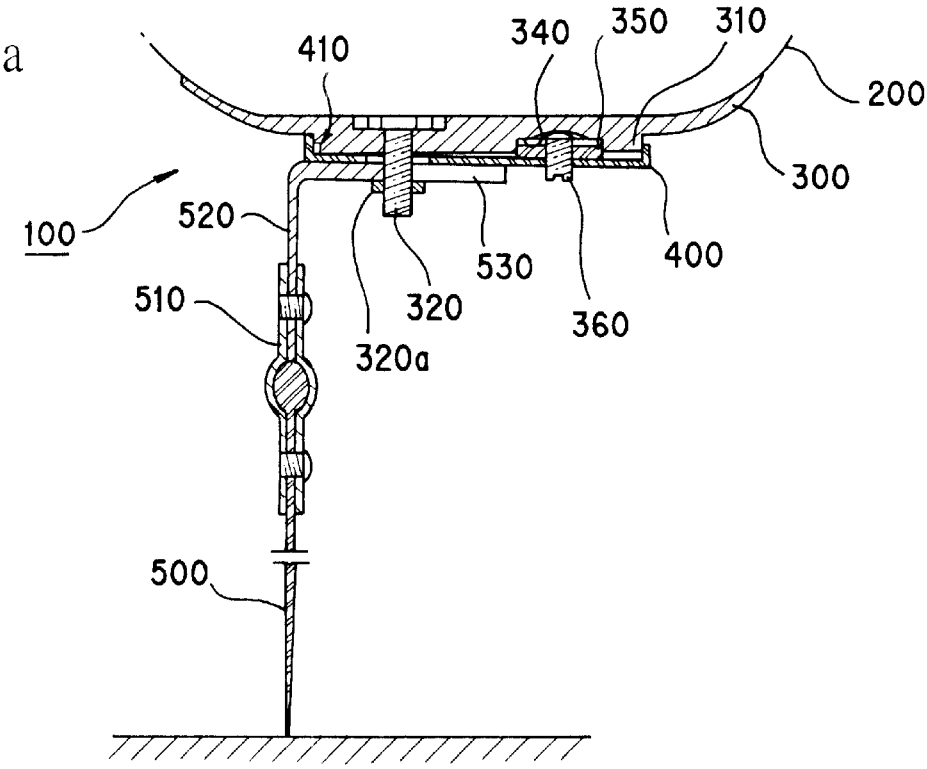
Figure 3B:
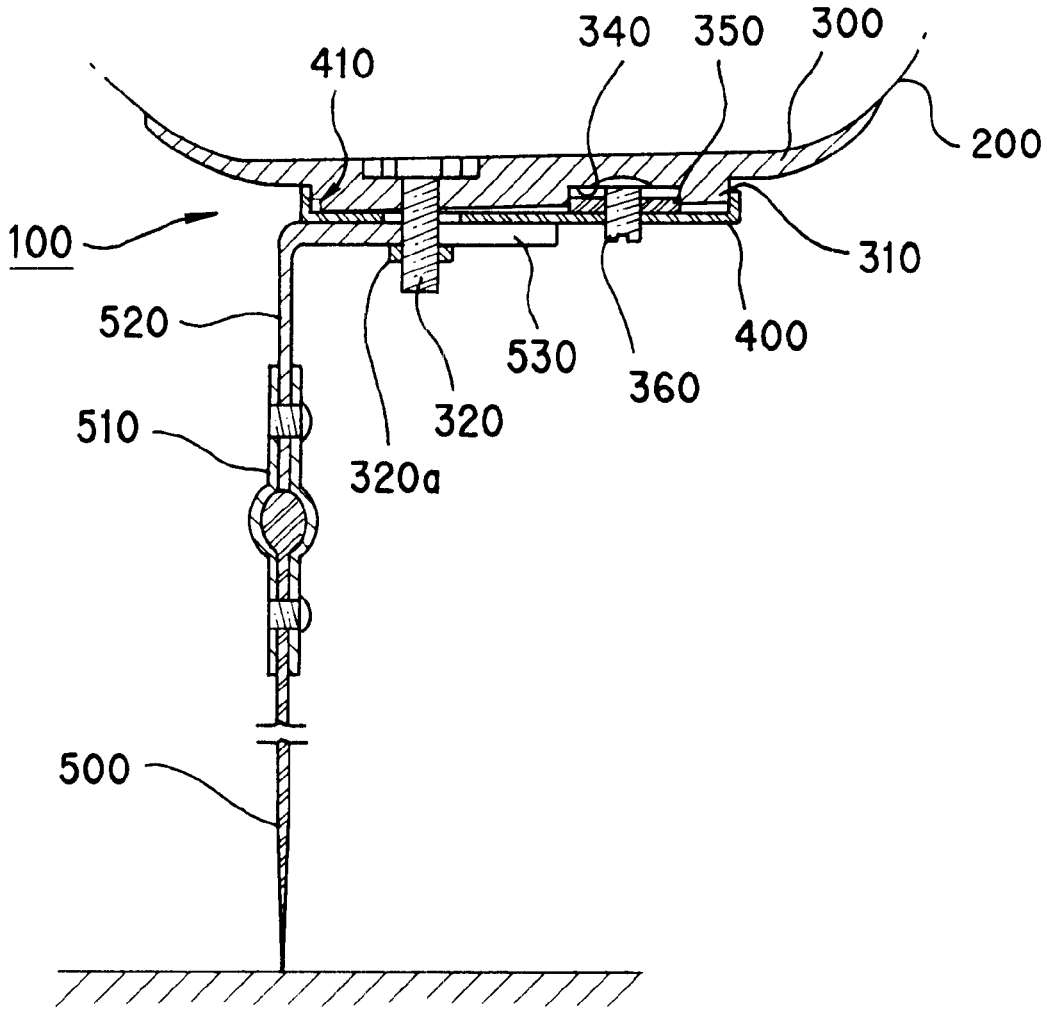
Figure 4:
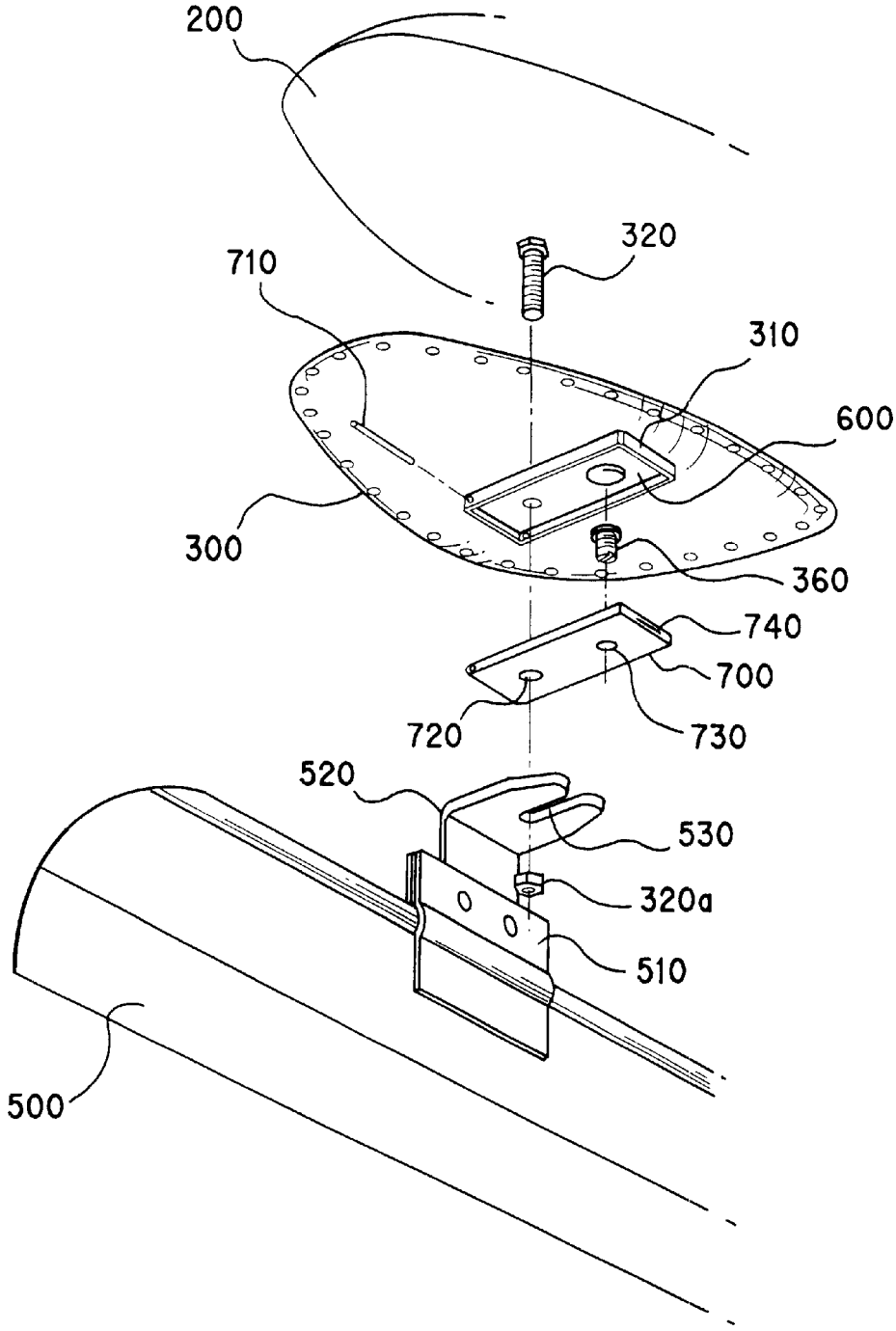
Figure 5:
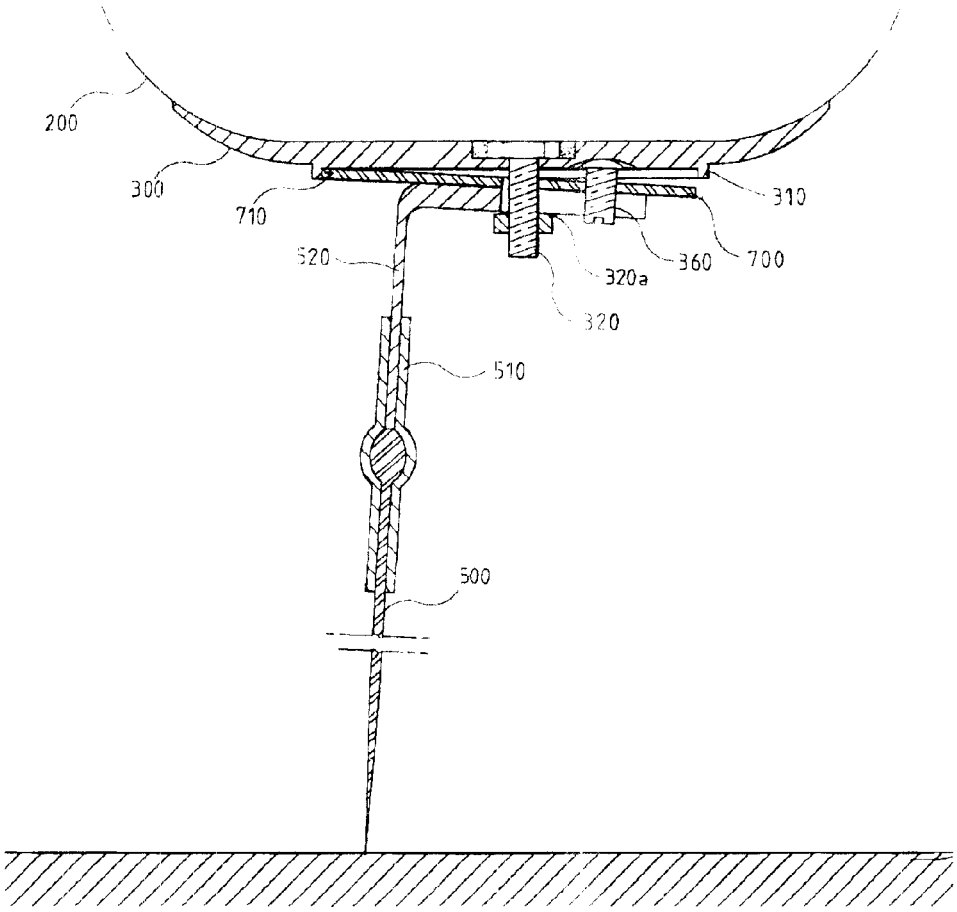
Figure 6:
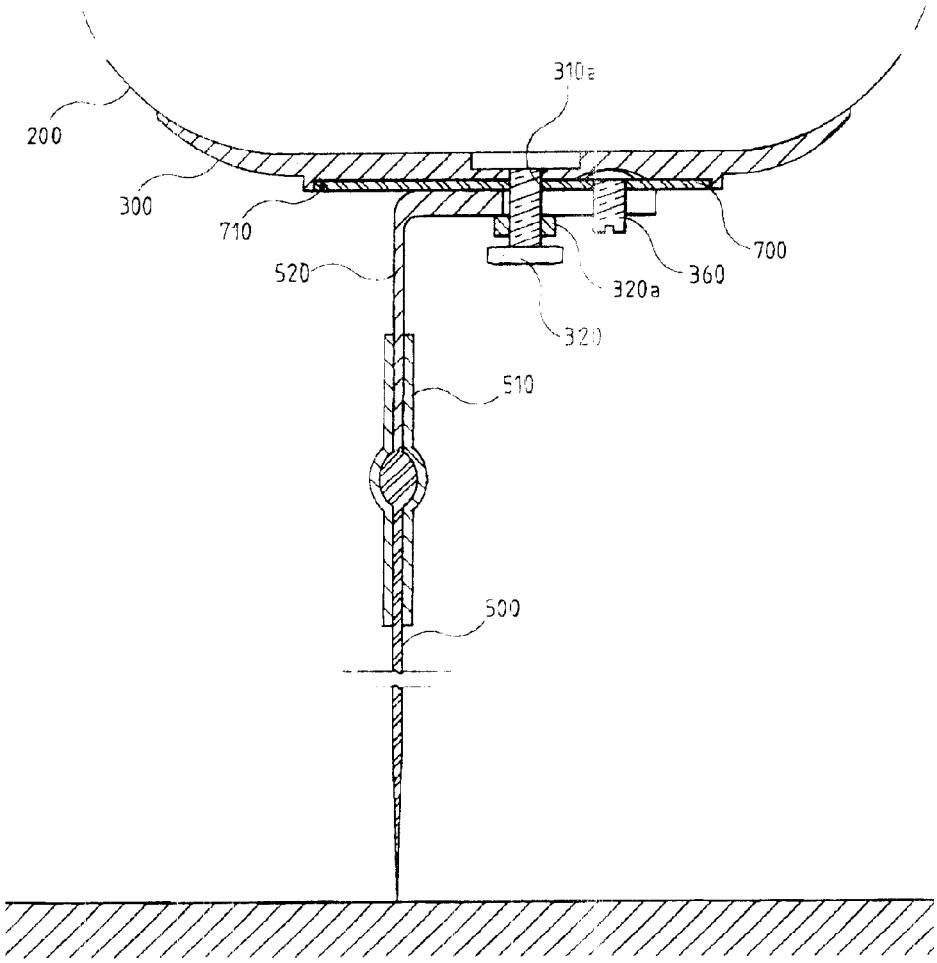

FIG. 3*a* depicts an enlarged cross-sectional view as an inventive use state view providing a state of rapidly skating on a straight-line portion of a track;

FIG. 3*b* represents an enlarged cross-sectional view as an inventive use state view providing a state of rapidly skating on a cornering portion of the track;

FIG. 4 presents a partially enlarged exploded perspective view showing another embodiment in accordance with the present invention;

FIG. 5 is an enlarged cross-sectional view showing a combined state of FIG. 4; and FIG. 6 provides a partially enlarged cross-sectional view showing another embodiment of the invention.

DETAILED DESCRIPTION OF THE PREFERRED EMBODIMENT

Reference will now be made in detail to the preferred embodiments of the present invention, examples of which are illustrated in the accompanying drawings.

Figure 1:
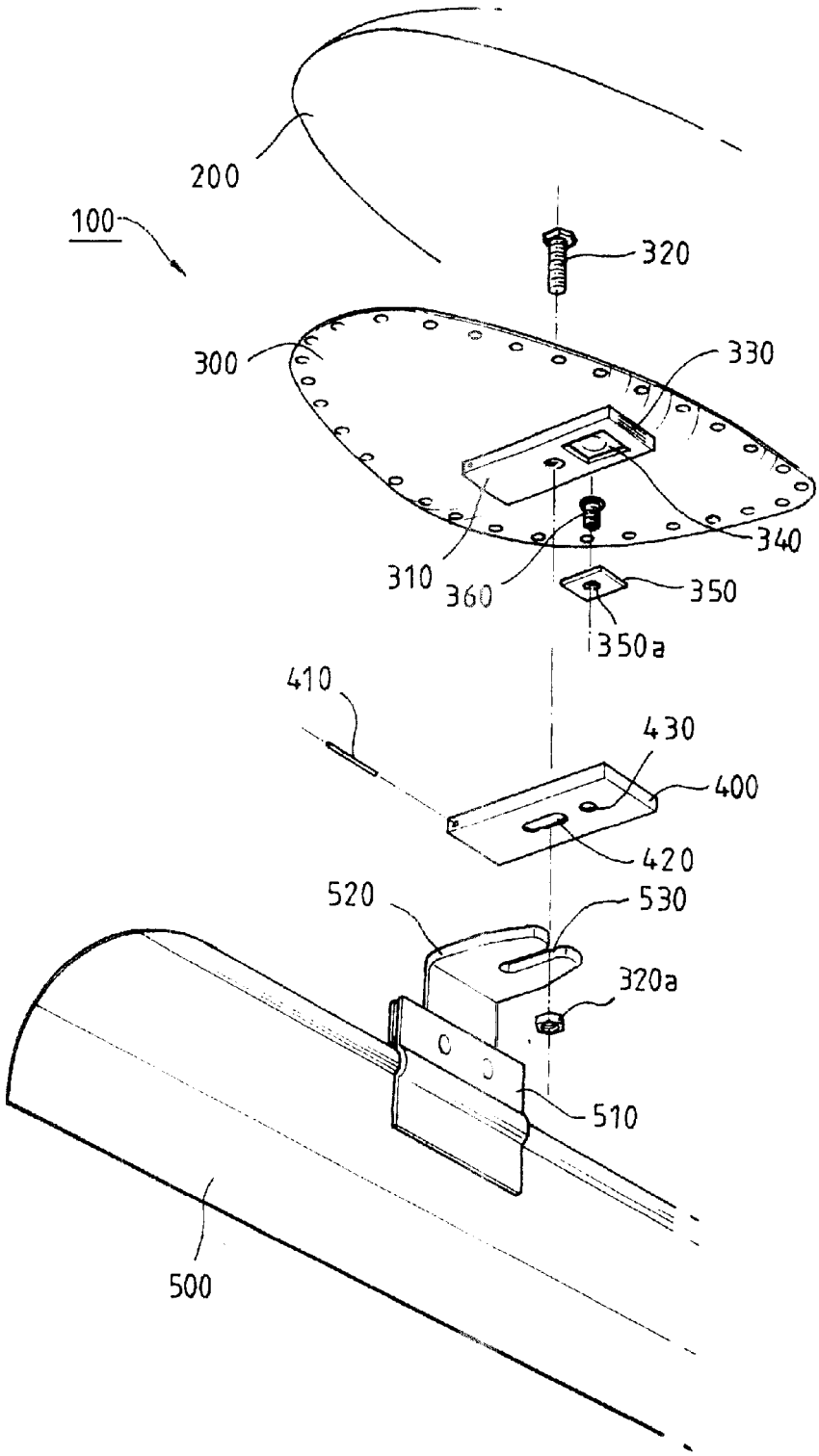
FIG. 1 is an exploded perspective view showing the construction in accordance with the present invention.
Figure 2:
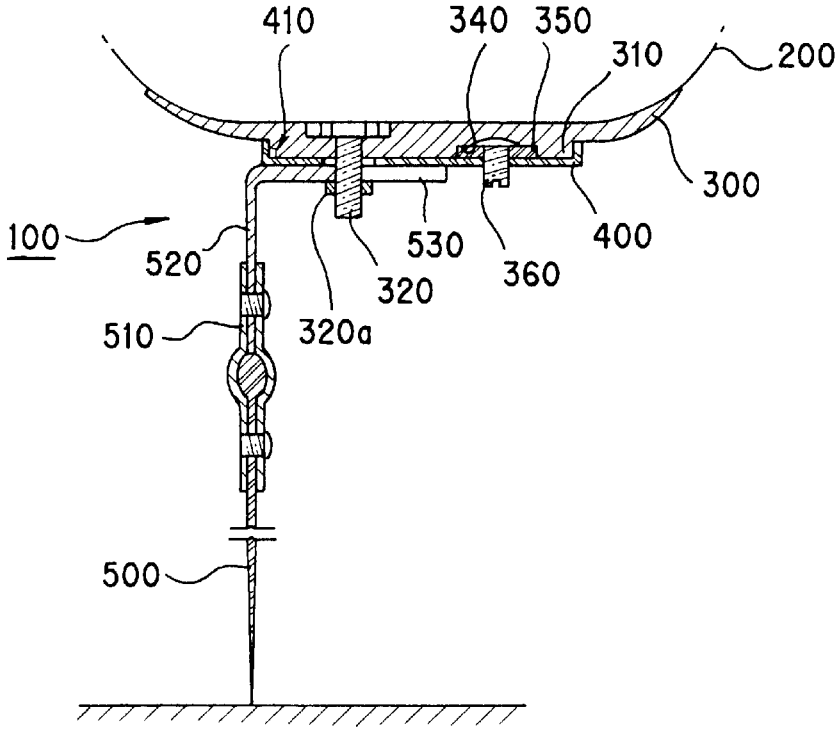
FIG. 2 illustrates an enlarged cross-sectional view showing an inventive combination state.

FIG. 1 is an exploded perspective view showing the construction in accordance with the present invention, and FIG. 2 is a partially enlarged cross-sectional view showing an inventive combination state. Skate 100 for a short track is made of a leather material and has a tightening string on a front side thereof. On respective front and back sides of a lower face of skate shoe 200, a fixing plate 300 made of metal material is closely fixed by a fastening bolt, and on a center part of a lower face of the fixing plate 300 a projection part 310 having a rectangular shape is formed in one piece with the fixing plate 300 to project downwardly.

Herewith, the projection part 310 has a graduation 330 on one side face thereof so as to clarify its incline when an angle of the skate blade to be described below is controlled and to control the exact angle.

The projection part 310 is provided with a fastening bolt 320 which extends from an upper part of the fixing plate through a connection flat 520 and then is fastened and fixed by a fastening nut 320*a* in its extension state, and the projection part 310 also has a concave flute 340 having a rectangular concave shape formed toward its inner side on one side thereof.

The concave flute 340 is preferably formed by a concave depth same as a height of the fixing plate, and is also provided with a controlling plate 350 having a fastening hole 350*a* into which a controlling screw 360 pierces, the fastening hole 350*a* being formed on a center thereof.

In a state that a lower part of the projection part 310 is covered from the lower direction with a pivotally moving part 400, one side of the pivotally moving part 400 is combined with the projection part 310 and a hinge axle 410 extending along a hinge axis, and the pivotally moving part 400 optionally and pivotally moves centering on the hinge axis.

The pivotally moving part 400 has a rectangular shape whose upper face is opened so as to cover the projection part, and has a long hole 420 formed on a bottom face thereof so as to be freely movable centering on the hinge axis under a state that the fastening bolt 320 extends through it, and also has a penetration hole 430 into which a controlling screw 360 penetrates through and fastens to the controlling plate 350 inserted into the concave flute 340.

At this time, in the penetration hole 430, an end part of the controlling screw 360 is exposed so as to be turned through the penetration hole 430 from the a lower part of the pivotally moving part 400.

On front and back upper parts of a skate blade 500, a holder 510 is fixed thereto, and in such a fixing state of a lower part of the holder, its upper part is bent in a horizontal shape and is provided with the connection flat 520 whose end part is opened to form an opening flute 530 so as to be fastened by insertion of the fastening bolt 320 and the fastening nut 320*a*.

Operations of the invention with such construction are described as follows.

First, from an upper part of the controlling plate 350 the controlling screw 360 is fastened through the fastening hole 350*a* so the controlling plate 350 is inserted inside the concave flute 340 of the projection part 310, and in this state, a lower part of the projection part 310 is covered by the pivotally moving part 400. Then, the fastening bolt 320 penetrates through the long hole 420, and under a state that the controlling screw 360 projects through a lower part of the controlling plate 350, is positioned into the penetration hole 430. The pivotally moving part 400 covers the projection part 310, and then its one side has an insertion of the hinge axle 410 to obtain a combination between the pivotally moving part 400 and the projection part 310. Therefore the pivotally moving part 400 can freely move while centering on the hinge axle 410.

Then, the fixing plate 300 described above is strongly fixed to the front and back sides of the skate shoe 200 lower face. In this state, the fastening bolt 320 projecting to a lower part of the pivotally moving part 400 is inserted into the opening flute 530 and is securely fastened by using the fastening nut 320a from a lower part of the connection flat 520, wherein the opening flute 530 is formed opened from an end part of the connection flat 520 combined with the holder 510 provided on front and back sides of the skate blade 500 upper part.

At this time, for skates used for the short track, the skate blade 500 is not positioned on a centering portion of the skate shoe 200 but is positioned eccentrically outwardly with the track as its starting point. That is, a position of the skate blade 500 is controlled so as to comply with the player's own ability by using the opening flute 530 formed by opening the end part of the connection flat 520, the opening flute 530 having an insertion of the fastening bolt 320, and then under such control state, its assembly is gained by securely tightening the fastening nut 320*a*.

When the assembly is completed as the above, as shown in FIG. 2, it is maintained in a close contact state of the controlling plate 350 within the concave flute 340. Thus, a vertical state of the skate blade 500 is maintained.

In this state, in case that an angle of the skate blade 500 should be controlled to match it with a player's own ability, the fastening nut 320*a* is first loosened so that the pivotally moving part 400 can move while centering on the hinge axle 410 and then the controlling screw 360 positioned in the penetration hole 430 provided in the pivotally moving part 400 is turned. Therefore, a downward position of the controlling plate 350 inserted into the inside of the concave flute 340 can be realized according to a pivotally moving range of the controlling screw 360.

Namely, when the controlling screw is turned under a state that the controlling screw 360 is screw-fastened to the fastening hole 350*a* of the controlling plate 350 and its end face is contacted with an upper face of the concave flute 340, the position of the controlling screw rotates without displacement. According to that, the controlling plate 350 screw-fastened by the controlling screw and the fastening hole is escaped to the outside from the inside of the concave flute 340.

Like this, when the controlling plate 350 inserted into the inside of the concave flute 340 is escaped downwardly by the controlling screw 360, one end side part of the pivotally moving part 400 face-contacted with the controlling plate, namely, another end part of the hinge axle 410, is downwardly moved centering on the hinge axis, to thereby obtain its inclined state.

When one end of the pivotally moving part 400 is slanted centering on the hinge axis as the above, its slanted angle can be precisely controlled by the graduation 330 appearing one face of the projection part 310.

That is, when the controlling plate 350 maintains a state completely inserted into the inside of the concave flute 340 so the pivotally moving part 400 covering an outer circumference of the projection part 310 maintains a horizontal state, the graduation 330 hidden by the pivotally moving part 400 is not shown. Then, when the controlling plate 350 is moved downwardly from the concave flute 340 by a control of the controlling bolt 360 so the pivotally moving part 400 maintaining its horizontal state moves centering on the hinge axle 410, the graduation 330 appearing on one face of the projection part 310 is visible to the naked eye according to a pivotally moving angle of the pivotally moving part, whereby the pivotally moving angle of the pivotally moving part 400 can be controlled by the graduation 330.

When the angle control is completed as the above, the fastening nut 320*a* loosened is tightened so that the skate blade 500 is fastened and fixed securely, maintaining the inclined angle, as shown in FIGS. 3*a* and 3*b*.

Under such state that an angle of the skate blade 500 is controlled, when the player stands with his skates on or rapidly skates on a straight line of the ice track, in this case the player is in a vertically standing state as shown in FIG. 3*a*. In other words, the skate shoe 200 maintains its horizontal state so the skate blade 500 having an inclined angle in the lower part of the skate shoe rapidly skates on the frozen surface under a maintenance state of the inclined angle controlled toward an inside direction of the track. While cornering, the player leans his upper body to an inside of the track at a maximum, and according to that, the skate shoe 200 is slanted to the inclined direction of the body as shown in FIG. 3*b*, thus the skate blade 500 inclines together with that. At this time, the skate blade 500 is based on the inclined state to the track direction, instead of maintaining the vertical state against the skate shoe 200, thus the skate blade 500 can stand vertically, meeting the body's inclined angle.

Therefore, the body maintains the inclined state to the inside direction of the track. Meanwhile, the skate blade 500 rapidly skates on the corner portion of the track under a maintenance of a vertically standing state without a sliding action from the ice surface by an increased contacting force with the frozen surface. Accordingly, the player can safely skate at a rapid speed on a corner portion of the track under its free control.

In accordance with another preferred embodiment of the invention, as shown in FIGS. 4 and 5, a concave part 600 is constructed having a concave shape formed into an inner side thereof forming an outer edge on the projection part 310 with a rectangular shape projecting as a unitary construction with a lower part of the fixing plate 300. The concave part 600 is combined with the projection part 310 by a one side insertion of a hinge axle 710 inserted into the inside of the concave part 600. It is also constructed with an angle controlling plate 700 movable while centering on the hinge axis.

This angle controlling plate 700 has a formation of a long hole 720 into which the fastening bolt 320 can be penetrated and a formation of a fastening hole 730 to which the controlling screw 360 can be fastened, and is further provided with a graduation 740 appearing on one side face of the angle controlling plate 700.

In a still another preferred embodiment of the invention, as shown in FIG. 6, the fastening hole 310*a* is constructed for screw-fastening from a lower part thereof. The fastening bolt 320 is formed in the fixing plate 300 then the fastening bolt 320 is fastened to the fastening hole 310*a* through the opening flute 530 from a lower part of the connection flat 520 fixed to the skate blade 500.

As aforementioned, in accordance with the present invention, a player himself can displace an angle between the skate shoe and the skate blade according to his/her physical condition and his/her individual skill extent by manipulating a controlling bolt. Thus, the skate blade maintains its vertical state against the frozen surface, that is, the skate shoe is slanted downwards in a cornering direction. Thus, there is no need to incline the body of the player by force when cornering. And also, even though the player's body is inclined in the cornering direction while cornering, the skate blade can rapidly skate, maintaining a vertical state against the frozen surface. Accordingly, there is no danger of sliding outwardly by centrifugal force even while rapidly skating on a corner portion of the track since the contacting force between the skate blade and the frozen surface does not have any displacement. Thus, not only accidental injury can be prevented, but also a good score in a game can be obtained by maintaining a rapid speed while safely cornering.

In addition, an economic burden of exchanging new skates and its inconvenience of the players can be eliminated using the invention which are caused every time the angle needs to be displaced, by voluntarily controlling the angle through a use of a controlling bolt, when a change of the skate shoes and the skate blade is required according to a skill extent of the players.

Although the invention has been shown and described with respect to the preferred embodiments, it will be understood by those skilled in the art that various changes and modifications may be made without departing from the spirit and scope of the invention.

What is claimed is:

1. A skate blade angle controlling device, comprising:

a fixing plate;

a projection part having a rectangular shape and being formed on a lower portion of the fixing plate;

a connection flat having an opening flute, the connection flat being positioned below the fixing plate, wherein the connection flat is provided on an upper face of a skate blade and the projection part is positioned between the fixing plate and the connection flat;

a fastening bolt that passes from the fixing plate, through the projection part, through the opening flute of the connection flat, and is engaged by a fastening nut;

a pivotally moving part having an open upper face that is closed by a lower part of the projection part, wherein one side of the pivotally moving part is pivotally movable by a hinge axle;

a concave shaped flute that is provided in the projection part and extends from the lower part of the projection part toward an inner portion of the projection part, wherein the concave shaped flute is positioned in the projection part at a location that is opposite of the location of the hinge axle on the pivotally moving part;

a controlling plate formed so as to be inserted into the concave flute, the controlling plate having a fastening hole; and a controlling screw that passes through the fastening hole of the controlling plate and controls an upward and downward pivoting angle of the controlling plate.

2. The device according to claim 1, wherein said projection part is provided with graduation formed on one side face thereof to exactly match the controlling angle, said graduation being visible to the naked eye.

3. A skate blade angle controlling device for controlling an angle of a skate blade affixed to a connection flat, comprising:

a rectangular shaped projection part formed on a lower portion of a fixing plate and configured to receive a fastening bolt;

a concave shaped flute formed in a lower face of the projection part;

an angle controlling plate that is combined with the projection part so as to be pivotally moved by a hinge axle located inside the concave shape flute, wherein the angle controlling plate includes a fastening hole; and a controlling screw that passes through the fastening hole of the angle controlling plate and controls an angle of the angle controlling plate.

4. The device according to claim 3, wherein said projection part is provided with graduation formed on one side face thereof to exactly match the controlling angle of the skate blade, said graduation being visible to the naked eye.

5. The device according to claim 1 or 3, wherein the projection part has a fastening hole that receives the fastening bolt to securely fix the projection part to the skate blade.

* * * * *